US007947636B2

(12) United States Patent
Saathoff et al.

(10) Patent No.: US 7,947,636 B2
(45) Date of Patent: May 24, 2011

(54) POWER TRANSMISSION FLUIDS

(75) Inventors: Lee D. Saathoff, Glen Allen, VA (US); Kenji Yatsunami, Tokyo (JP)

(73) Assignee: Afton Chemical Corporation, Richmond, VA (US)

( * ) Notice: Subject to any disclaimer, the term of this patent is extended or adjusted under 35 U.S.C. 154(b) by 1071 days.

(21) Appl. No.: 10/788,732

(22) Filed: Feb. 27, 2004

(65) Prior Publication Data

US 2005/0192185 A1 Sep. 1, 2005

(51) Int. Cl.
*C10M 133/06* (2006.01)
*C10M 133/56* (2006.01)

(52) U.S. Cl. ..... 508/545; 508/291

(58) Field of Classification Search ..... 508/545, 508/291

See application file for complete search history.

(56) References Cited

U.S. PATENT DOCUMENTS

| | | | |
|---|---|---|---|
| 2,284,409 | A | 5/1942 | Erath |
| 2,284,410 | A | 5/1942 | Farmer |
| 2,459,112 | A | 1/1949 | Oberright |
| 2,962,442 | A | 11/1960 | Andress |
| 2,984,550 | A | 5/1961 | Chamot |
| 3,018,247 | A | 1/1962 | Anderson et al. |
| 3,018,250 | A | 1/1962 | Anderson et al. |
| 3,018,291 | A | 1/1962 | Anderson et al. |
| 3,036,003 | A | 5/1962 | Verdol |
| 3,087,936 | A | 4/1963 | Le Suer |
| 3,163,603 | A | 12/1964 | Le Suer |
| 3,166,516 | A | 1/1965 | Kirkpatrick et al. |
| 3,172,892 | A | 3/1965 | Suer et al. |
| 3,184,411 | A | 5/1965 | Lowe |
| 3,184,474 | A | 5/1965 | Catto et al. |
| 3,185,645 | A | 5/1965 | Clayton |
| 3,185,704 | A | 5/1965 | Kahn et al. |
| 3,194,812 | A | 7/1965 | Norman et al. |
| 3,194,814 | A | 7/1965 | Le Suer et al. |
| 3,200,107 | A | 8/1965 | Le Suer |
| 3,202,678 | A | 8/1965 | Stuart et al. |
| 3,215,707 | A | 11/1965 | Rense |
| 3,216,936 | A | 11/1965 | Le Suer |
| 3,219,666 | A | 11/1965 | Norman et al. |
| 3,231,587 | A | 1/1966 | Rense |
| 3,236,770 | A | 2/1966 | Matson et al. |
| 3,254,025 | A | 5/1966 | Le Suer |
| 3,256,185 | A | 6/1966 | Le Suer |
| 3,271,310 | A | 9/1966 | Le Suer |
| 3,272,746 | A | 9/1966 | LeSuer et al. |

(Continued)

FOREIGN PATENT DOCUMENTS

| | | |
|---|---|---|
| CN | 85103931 | 5/1985 |

(Continued)

OTHER PUBLICATIONS

Patent Office of the People'S Republic of China, Office Action, Apr. 2006.

*Primary Examiner* — Glenn Caldarola
*Assistant Examiner* — Jim Goloboy
(74) *Attorney, Agent, or Firm* — Luedeka, Neely & Graham, P.C.

(57) ABSTRACT

A power transmission fluid composition having improved characteristics. The fluid may include a base oil and an additive composition, wherein the additive composition includes an ashless dispersant and an oil-soluble aliphatic tertiary amine. The resulting fluid may have improved durability characteristics.

17 Claims, 6 Drawing Sheets

U.S. PATENT DOCUMENTS

| | | | | |
|---|---|---|---|---|
| 3,275,554 | A | | 9/1966 | Wagenaar |
| 3,278,550 | A | | 10/1966 | Norman et al. |
| 3,280,034 | A | | 10/1966 | Anzenburger et al. |
| 3,281,357 | A | | 10/1966 | Vogel |
| 3,281,428 | A | | 10/1966 | Le Suer |
| 3,282,955 | A | | 11/1966 | Le Suer |
| 3,284,410 | A | | 11/1966 | Meinhardt |
| 3,287,271 | A | | 11/1966 | Stuart et al. |
| 3,306,908 | A | | 2/1967 | Le Suer |
| 3,311,558 | A | | 3/1967 | Prizer et al. |
| 3,312,619 | A | | 4/1967 | Vineyard |
| 3,316,177 | A | | 4/1967 | Dorer, Jr. |
| 3,329,658 | A | | 7/1967 | Fields |
| 3,331,776 | A | | 7/1967 | Krukziener |
| 3,338,832 | A | | 8/1967 | Le Suer |
| 3,340,281 | A | | 9/1967 | Brannen, Jr. |
| 3,341,542 | A | | 9/1967 | Le Suer et al. |
| 3,344,069 | A | | 9/1967 | Stuebe |
| 3,346,354 | A | | 10/1967 | Kautsky |
| 3,346,493 | A | | 10/1967 | Le Suer |
| 3,347,645 | A | | 10/1967 | Pietsch et al. |
| 3,351,552 | A | | 11/1967 | Le Suer |
| 3,355,270 | A | | 11/1967 | Amick et al. |
| 3,359,204 | A | | 12/1967 | Knapp |
| 3,361,673 | A | | 1/1968 | Stuart et al. |
| 3,366,569 | A | | 1/1968 | Norman et al. |
| 3,367,943 | A | | 2/1968 | Miller et al. |
| 3,368,972 | A | | 2/1968 | Otto |
| 3,369,021 | A | | 2/1968 | Le Suer |
| 3,373,111 | A | | 3/1968 | Le Suer et al. |
| 3,381,022 | A | | 4/1968 | Le Suer |
| 3,390,086 | A | | 6/1968 | O'Halloran |
| RE26,433 | E | | 8/1968 | Le Suer |
| 3,399,141 | A | | 8/1968 | Clemens |
| 3,401,118 | A | | 9/1968 | Benoit, Jr. |
| 3,413,347 | A | | 11/1968 | Worrel |
| 3,415,750 | A | | 12/1968 | Anzenberger |
| 3,433,744 | A | | 3/1969 | Le Suer |
| 3,438,757 | A | | 4/1969 | Honnen et al. |
| 3,442,808 | A | | 5/1969 | Traise et al. |
| 3,444,170 | A | | 5/1969 | Norman et al. |
| 3,448,047 | A | | 6/1969 | Traise et al. |
| 3,448,048 | A | | 6/1969 | Le Suer et al. |
| 3,448,049 | A | | 6/1969 | Preuss et al. |
| 3,449,250 | A | | 6/1969 | Fields |
| 3,451,933 | A | | 6/1969 | Leister |
| 3,454,497 | A | | 7/1969 | Wittner |
| 3,454,555 | A | | 7/1969 | Voort et al. |
| 3,454,607 | A | | 7/1969 | Le Suer et al. |
| 3,458,530 | A | | 7/1969 | Siegel et al. |
| 3,459,661 | A | | 8/1969 | Schlobohm |
| 3,461,172 | A | | 8/1969 | Previc |
| 3,467,668 | A | | 9/1969 | Gruber et al. |
| 3,470,098 | A | | 9/1969 | O'Halloran |
| 3,493,520 | A | | 2/1970 | Verdol et al. |
| 3,501,405 | A | | 3/1970 | Willette |
| 3,502,677 | A | | 3/1970 | Le Suer |
| 3,511,780 | A | | 5/1970 | Neblett et al. |
| 3,513,093 | A | | 5/1970 | Le Suer |
| 3,519,565 | A | | 7/1970 | Coleman |
| 3,522,179 | A | | 7/1970 | Suer |
| 3,533,945 | A | | 10/1970 | Vogel |
| 3,539,633 | A | | 11/1970 | Piasek et al. |
| 3,541,012 | A | | 11/1970 | Stuebe |
| 3,542,680 | A | | 11/1970 | Le Suer |
| 3,551,466 | A | | 12/1970 | Gee et al. |
| 3,558,743 | A | | 1/1971 | Verdol et al. |
| 3,565,804 | A | | 2/1971 | Honnen et al. |
| 3,567,637 | A | | 3/1971 | Sabol |
| 3,573,205 | A | | 3/1971 | Lowe |
| 3,574,101 | A | | 4/1971 | Murphy |
| 3,576,743 | A | | 4/1971 | Widmer et al. |
| 3,578,422 | A | | 5/1971 | Dorer, Jr. |
| 3,586,629 | A | | 6/1971 | Otto et al. |
| 3,591,598 | A | | 7/1971 | Traise et al. |
| 3,600,372 | A | | 8/1971 | Udelhofen et al. |
| 3,630,904 | A | | 12/1971 | Musser et al. |
| 3,632,510 | A | | 1/1972 | Le Suer |
| 3,632,511 | A | | 1/1972 | Liao |
| 3,634,515 | A | | 1/1972 | Piasek et al. |
| 3,649,229 | A | | 3/1972 | Otto |
| 3,652,616 | A | | 3/1972 | Watson et al. |
| 3,658,494 | A | | 4/1972 | Dorer, Jr. |
| 3,658,495 | A | | 4/1972 | Dorer, Jr. |
| 3,658,836 | A | | 4/1972 | Vineyard |
| 3,666,730 | A | | 5/1972 | Coleman |
| 3,687,849 | A | | 8/1972 | Abbott |
| 3,697,428 | A | | 10/1972 | Meinhardt et al. |
| 3,697,574 | A | | 10/1972 | Piasek et al. |
| 3,702,300 | A | | 11/1972 | Coleman |
| 3,703,536 | A | | 11/1972 | Piasek et al. |
| 3,704,308 | A | | 11/1972 | Piasek et al. |
| 3,718,663 | A | | 2/1973 | Piasek et al. |
| 3,720,615 | A | * | 3/1973 | Izumi et al. ..... 508/306 |
| 3,725,277 | A | | 4/1973 | Worrel |
| 3,725,441 | A | | 4/1973 | Murphy |
| 3,725,480 | A | | 4/1973 | Traise et al. |
| 3,726,882 | A | | 4/1973 | Traise et al. |
| 3,736,357 | A | | 5/1973 | Piasek et al. |
| 3,749,695 | A | | 7/1973 | de Vries |
| 3,751,365 | A | | 8/1973 | Piasek et al. |
| 3,756,953 | A | | 9/1973 | Piasek et al. |
| 3,793,202 | A | | 2/1974 | Piasek et al. |
| 3,798,165 | A | | 3/1974 | Piasek et al. |
| 3,798,247 | A | | 3/1974 | Piasek et al. |
| 3,803,039 | A | | 4/1974 | Piasek et al. |
| 3,804,763 | A | | 4/1974 | Meinhardt et al. |
| 3,836,471 | A | | 9/1974 | Miller |
| 3,862,981 | A | | 1/1975 | Demoures et al. |
| 3,865,740 | A | | 2/1975 | Goldschmidt |
| 3,865,813 | A | | 2/1975 | Gergel |
| 3,872,019 | A | | 3/1975 | Culbertson et al. |
| 3,904,595 | A | | 9/1975 | Plonsker et al. |
| 3,912,764 | A | | 10/1975 | Palmer, Jr. |
| 3,936,480 | A | | 2/1976 | Demoures et al. |
| 3,948,800 | A | | 4/1976 | Meinhardt |
| 3,950,341 | A | | 4/1976 | Okamoto et al. |
| 3,954,639 | A | | 5/1976 | Liston |
| 3,957,746 | A | | 5/1976 | Malec |
| 3,957,854 | A | | 5/1976 | Miller |
| 3,957,855 | A | | 5/1976 | Miller |
| 3,980,569 | A | | 9/1976 | Pindar et al. |
| 3,985,802 | A | | 10/1976 | Piasek et al. |
| 3,991,098 | A | | 11/1976 | Okamoto |
| 4,006,089 | A | | 2/1977 | Chibnik |
| 4,011,380 | A | | 3/1977 | West et al. |
| 4,025,451 | A | | 5/1977 | Plonsker et al. |
| 4,058,468 | A | | 11/1977 | Malec |
| 4,071,548 | A | | 1/1978 | Okamoto |
| 4,083,699 | A | | 4/1978 | Chibnik |
| 4,090,854 | A | | 5/1978 | Davis |
| 4,110,349 | A | | 8/1978 | Cohen |
| 4,173,540 | A | | 11/1979 | Lonstrup et al. |
| 4,177,153 | A | * | 12/1979 | Lowe ..... 508/334 |
| 4,234,435 | A | | 11/1980 | Meinhardt et al. |
| 4,338,205 | A | | 7/1982 | Wisotsky |
| 4,354,950 | A | | 10/1982 | Hammond et al. |
| 4,374,033 | A | | 2/1983 | Malec |
| 4,401,581 | A | | 8/1983 | Burrows et al. |
| 4,410,437 | A | | 10/1983 | Erdman |
| 4,428,849 | A | | 1/1984 | Wisotsky |
| 4,455,243 | A | | 6/1984 | Liston |
| 4,485,023 | A | | 11/1984 | Serres et al. |
| 4,548,724 | A | | 10/1985 | Karol et al. |
| 4,554,086 | A | | 11/1985 | Karol et al. |
| 4,608,185 | A | | 8/1986 | Buckley |
| 4,612,132 | A | | 9/1986 | Wollenberg et al. |
| 4,614,603 | A | | 9/1986 | Wollenberg |
| 4,615,826 | A | | 10/1986 | Erdman |
| 4,645,515 | A | | 2/1987 | Wollenberg |
| 4,652,387 | A | | 3/1987 | Andress, Jr. et al. |
| 4,710,201 | A | | 12/1987 | Buckley |
| 4,713,191 | A | | 12/1987 | Nalesnik |
| 4,746,446 | A | | 5/1988 | Wollenberg et al. |
| 4,747,963 | A | | 5/1988 | Wollenberg |
| 4,747,964 | A | | 5/1988 | Durand et al. |
| 4,747,965 | A | | 5/1988 | Wollenberg et al. |

| | | | | | |
|---|---|---|---|---|---|
| 4,795,583 | A | * | 1/1989 | Papay | 252/77 |
| 4,822,508 | A | | 4/1989 | Pennewiss et al. | |
| 4,857,214 | A | | 8/1989 | Papay et al. | |
| 4,863,623 | A | | 9/1989 | Nalesnik | |
| 5,043,087 | A | | 8/1991 | Pennewiss et al. | |
| 5,075,383 | A | | 12/1991 | Migdal et al. | |
| 5,137,980 | A | | 8/1992 | De Gonia et al. | |
| 5,344,579 | A | * | 9/1994 | Ohtani et al. | 508/284 |
| 5,441,656 | A | | 8/1995 | Ohtani et al. | |
| 5,597,506 | A | * | 1/1997 | Bloch et al. | 508/421 |
| 5,634,951 | A | | 6/1997 | Colucci et al. | |
| 5,725,612 | A | | 3/1998 | Malfer et al. | |
| 5,789,353 | A | | 8/1998 | Scattergood | |
| 5,843,874 | A | | 12/1998 | Macpherson et al. | |
| 5,880,073 | A | | 3/1999 | Tomizawa et al. | |
| 5,955,405 | A | | 9/1999 | Liesen et al. | |
| 6,225,266 | B1 | * | 5/2001 | Watts et al. | 508/193 |
| 6,303,546 | B1 | | 10/2001 | Hata et al. | |
| 6,528,694 | B1 | | 3/2003 | Chiga | |
| 6,593,281 | B2 | | 7/2003 | Sato et al. | |
| 6,660,695 | B2 | | 12/2003 | Watts et al. | |
| 6,844,301 | B2 | * | 1/2005 | Field et al. | 508/485 |
| 2005/0090409 | A1 | | 4/2005 | Devlin et al. | |

FOREIGN PATENT DOCUMENTS

| | | | |
|---|---|---|---|
| CN | 1004521 | A | 10/1986 |
| CN | 1172047 | A | 2/1998 |
| EP | 407124 | | 1/1991 |
| EP | 0 700 980 | A1 | 10/1997 |
| EP | 1233054 | | 8/2002 |
| EP | 1239021 | A2 | 9/2002 |
| GB | 1085903 | | 10/1967 |
| GB | 1162436 | | 8/1969 |
| JP | 59071395 | A | 4/1984 |
| JP | 6240275 | | 8/1994 |
| WO | 00/14187 | A | 3/2000 |

* cited by examiner

POWER TRANSMISSION FLUIDS

FIELD

The present disclosure relates to power transmission fluids having improved durability characteristics. More particularly, an additive for transmission fluids is described which serves to provide increasing anti-friction properties to the fluid as a function of time. This serves to compensate for a loss of anti-friction properties of the fluid which typically occurs as anti-friction properties of other components of the fluid degrade over time.

BACKGROUND

Power transmission fluids incorporate various additives in an effort to improve and control friction properties of the fluid. It has been observed that the friction properties of various additives tend to decrease over time. This can lead to undesirable performance of the transmission device, such as shudder in slipping torque converter clutches, instability of dynamic friction in automatic transmission devices, and belt rattle in continuously variable transmissions. Accordingly, there is a need in the art for an additive which can stabilize and improve the friction properties of a transmission fluid over time to compensate for friction properties of the fluid which are otherwise lost over time to extend the useful life of the fluid.

SUMMARY OF THE INVENTION

Power transmission fluids formulated according to the present disclosure provide improved frictional durability to extend the useful life of the fluid.

In an embodiment, a power transmission fluid composition having improved characteristics is provided. The fluid may include a base oil, an ashless dispersant, and an oil-soluble tertiary amine.

In other aspects, methods for making such fluids and adding to devices, such as vehicles, incorporating such fluids, are described.

It as been observed that fluids according to the invention advantageously feature better friction durability as compared to conventional fluids, with such advantage being empirically indicated as a noted decrease in the ratio of static to dynamic friction of the fluid as the fluid ages over time.

Both the foregoing general description and the following detailed description are exemplary and explanatory only and are intended to provide further explanation of the present embodiments.

DETAILED DESCRIPTION OF EMBODIMENTS

Figure 1A:
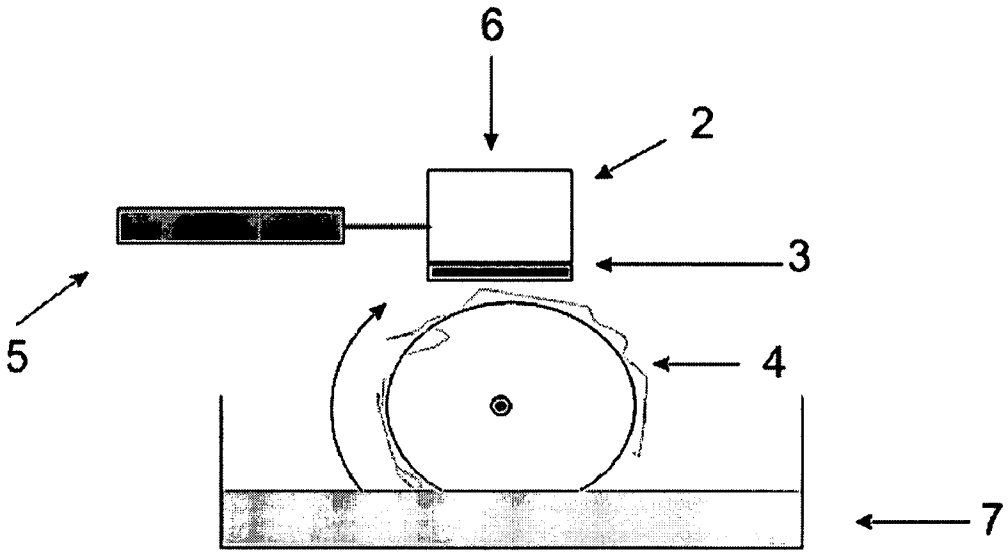
FIG. 1A is a schematic illustration of a fluid testing apparatus.

Various additives including ashless dispersants and friction modifiers have frequently been added to automatic transmission fluids. One problem often seen with automatic transmission fluids is that the effect of the additives in improving friction diminishes on aging. This can lead to shudder in slipping torque converter clutches, instability of dynamic friction in automatic transmissions, or belt rattle in continuously variable transmissions.

In some embodiments of the present disclosure, an additive composition is provided that enables the fluid to have a longer life with satisfactory friction performance. Improved durability of anti-shudder performance in slipping torque converters, dynamic friction in automatic transmissions, and anti-rattle performance in continuously variable transmissions is achieved by use of an initially substantially inert (friction-wise) compound and an ashless dispersant. When the fluid is subjected to the oxidative and thermal degradation conditions encountered under normal service conditions, the fluid degrades and its frictional performance would be expected to deteriorate.

However, treatment of the fluid according to the present disclosure has been observed to advantageously avoid or reduce such deterioration. In this regard, the fluid incorporates an additive, which is initially substantially inert (friction-wise), but which is believed to be transformed under operating conditions into an activated form which yields suitable performance characteristics in power transfer devices, such as anti-shudder characteristics in slipping torque converters, dynamic friction characteristics in automatic transmissions, and anti-rattle characteristics in continuously variable transmissions. Thus the additive employed pursuant to this invention serves as time-activated compensation for the degradation of other components in the formulation. The result is a continuation of good frictional performance over a long period of time during use of the fluid in a power transmission device.

In an embodiment, a power transmission fluid according to the invention may include a base oil and an additive composition comprising an ashless dispersant and an oil-soluble aliphatic tertiary amine component. As used herein, the term "oil-soluble" includes its ordinary meaning, which is well-known to those skilled in the art. For example, it means capable of dissolving to a concentration of at least about 0.1% by weight at about 25° C. in a paraffinic mineral oil having a viscosity in the range of about 4 to about 16 Centistokes at about 100° C.

The oil-soluble aliphatic tertiary amine component may comprise an oil-soluble aliphatic tertiary amine of the formula:

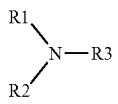

R1 may be an alkyl or an alkenyl group having from about 1 to about 4 carbon atoms, and R2 and R3 may be long chain substantially linear aliphatic groups independently containing from about 8 to about 100 carbon atoms. As a further example, R1 may be an alkyl group, such as a methyl group. Further, R2 and R3 may be, independently, an alkyl, an alkenyl, or an alkoxyalkyl group (although they may be an alkynyl, an alkylthioalkyl, a haloalkyl, a haloalkenyl, or like aliphatic groups) and they may contain as many as about 30, about 50, or even about 100 carbon atoms and as few as about 8, about 10, or about 12 carbon atoms. The resultant long chain tertiary amine may be oil soluble, i.e., capable of dissolving to a concentration of at least about 0.1% by weight at about 25° C. in a paraffinic mineral oil having a viscosity in the range of about 4 to about 16 Centistokes at about 100° C.

Examples of groups for R2 and R3 include unsaturated and saturated fatty acids. Suitable unsaturated fatty acids include palmitoleic, oleic, ricinoleic, petroselinic, vaccenic, linoleic, linolenic, oseostearic, licanic, paranaric, tariric, gadoleic, arachidonic, cetoleic, and the like, as well as other fatty acid ester materials obtained from animal fats and vegetable oils, such as tall oil, linseed oil, olive oil, castor oil, peanut oil, rapeseed oil, fish oil, sperm oil, coconut oil, lard oil, soybean oil, and mixtures thereof. Suitable saturated fatty acids include lignoceric, tricosanoic, behenic, heneicosanoic, arachidic, nonadecanoic, stearic, margaric, palmitic, pentadecanoic, myristic, lauric, tridecanoic, hendecanoic, and mixtures thereof.

As noted above, amine components of the above formula may initially be substantially inert with respect to friction reduction in the fluid. In this regard, and without being bound by theory, it is believed that the transformation of the additive from being initially substantially inert in regards to friction affecting properties to a state wherein it serves to provide beneficial friction affecting properties, for example, an oxidative mechanism.

Suitable aliphatic tertiary amines include methyl amine products available under the Trade Designation ARMEEN from Akzo Nobel, such as Dicocomethylamine available under the Trade Designation ARMEEN M2C, which has at least about 96% tertiary amine and a viscosity of about 7 mPa·s at 60° C.), and a Di(hydrogenated tallow) methylamine available under the Trade Designation ARMEEN M2HT, which has at least about 96% tertiary amine and a viscosity of 10 mPa·s at 60° C.

The amount of oil-soluble aliphatic tertiary amine component in the power transmission fluid may range from about 0.05 to about 8 percent by weight. As a further example, the amount of oil-soluble aliphatic tertiary amine component in the power transmission fluid may range from about 0.5 to about 1.5 percent by weight.

Base oils suitable for use in formulating transmission fluid compositions according to the present disclosure may be selected from any of the synthetic or natural oils or mixtures thereof. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. The base oil typically has a viscosity of, for example, about 2 to about 15 cSt and, as a further example, about 2 to about 10 cSt at 100° C.

The synthetic base oils may include alkyl esters of carboxylic acids, polyglycols and alcohols, poly-alpha-olefins, including polybutenes, alkyl benzenes, organic esters of phosphoric acids, and polysilicone oils. Synthetic oils may include hydrocarbon oils such as polymerized and interpolymerized olefins (e.g., polybutylenes, polypropylenes, propylene isobutylene copolymers, and the like); poly(1-hexenes), poly-(1-octenes), poly(1-decenes), and the like, and mixtures thereof; alkylbenzenes (e.g., dodecylbenzenes, tetradecylbenzenes, di-nonylbenzenes, di-(2-ethylhexyl)benzenes, and the like); polyphenyls (e.g., biphenyls, terphenyl, alkylated polyphenyls, and the like); alkylated diphenyl ethers and alkylated diphenyl sulfides and the derivatives, analogs and homologs thereof, and the like.

Hence, the base oil used which may be used to make the transmission fluid compositions as described herein may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≦0.03 | And | ≧90 | 80 to 120 |
| Group II | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

Ashless Dispersants

The ashless dispersant may be selected from any of the ashless dispersants known to those skilled in the art. Suitable ashless dispersants may include ashless dispersants such as succinimide dispersants, Mannich base dispersants, and polymeric polyamine dispersants.

Hydrocarbyl-substituted succinic acylating agents are used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (for example, the acid fluorides and acid chlorides), and the esters of the hydrocarbyl-substituted succinic acids and lower alcohols (for example, those containing up to about 7 carbon atoms), that is, hydrocarbyl-substituted compounds which can function as carboxylic acylating agents.

Hydrocarbyl substituted acylating agents may be made by reacting a polyolefin or chlorinated polyolefin of appropriate molecular weight with maleic anhydride. Similar carboxylic reactants can be used to make the acylating agents. Such reactants may include, but are not limited to, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The molecular weight of the olefin can vary depending upon the intended use of the substituted succinic anhydrides. Typically, the substituted succinic anhydrides may have a hydrocarbyl group of from about 8 to about 500 carbon atoms. However, substituted succinic anhydrides used to make lubricating oil dispersants may have a hydrocarbyl group of about 40 to about 500 carbon atoms.

The mole ratio of maleic anhydride to olefin can vary widely. It may vary, for example, from about 5:1 to about 1:5, or for example, from about 1:1 to about 3:1. Olefins such as polyisobutylene may have a number average molecular weight of about 500 to about 7000, or as a further example, about 800 to about 3000 or higher. The maleic anhydride may be used in stoichiometric excess, for example, about 1.1 to about 3 moles maleic anhydride per mole of olefin. The unreacted maleic anhydride can be vaporized from the resultant reaction mixture.

Polyalkenyl succinic anhydrides may be converted to polyalkyl succinic anhydrides by using conventional reducing conditions such as catalytic hydrogenation. For catalytic hydrogenation, a suitable catalyst is, for example, palladium on carbon. Likewise, polyalkenyl succinimides may be converted to polyalkyl succinimides using similar reducing conditions.

The polyalkyl or polyalkenyl substituent on the succinic anhydrides employed herein may generally be derived from polyolefins which are polymers or copolymers of mono-olefins, particularly 1-mono-olefins, such as ethylene, propylene, and butylene. The mono-olefin employed may have about 2 to about 24 carbon atoms, or as a further example, about 3 to about 12 carbon atoms. Other suitable mono-olefins include propylene, butylene, isobutylene, 1-octene, and 1-decene. Polyolefins prepared from such mono-olefins including polypropylene, polybutene, polyisobutene, and the polyalphaolefins produced from 1-octene and 1-decene.

In some embodiments, the ashless dispersant may include one or more alkenyl succinimides of an amine having at least one primary amino group capable of forming an imide group. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of polyolefin and maleic anhydride to about 180° to about 220° C. The polyolefin may be a polymer or copolymer of a lower monoolefin such as ethylene, propylene, isobutene, and the like, having a number average molecular weight in the range of about 300 to about 3000 as determined by gel permeation chromatography (GPC).

Amines which may be employed in forming the ashless dispersant may include any that have at least one primary amino group which can react to form an imide group and at least one additional primary or secondary amino group and/or at least one hydroxyl group. A few representative examples are: N-methyl-propanediamine, N-dodecylpropanediamine, N-aminopropyl-piperazine, ethanolamine, N-ethanol-ethylenediamine, and the like.

Suitable amines may include alkylene polyamines, such as propylene diamine, dipropylene triamine, di-(1,2-butylene) triamine, and tetra-(1,2-propylene)pentamine. A further example includes the ethylene polyamines which can be depicted by the formula $H_2N(CH_2CH_2NH)_nH$, wherein n may be an integer from about one to about ten. These include: ethylene diamine, diethylene triamine (DETA), triethylene tetramine (TETA), tetraethylene pentamine (TEPA), pentaethylene hexamine (PEHA), and the like, including mixtures thereof in which case n is the average value of the mixture. Such ethylene polyamines have a primary amine group at each end so they may form mono-alkenylsuccinimides and bis-alkenylsuccinimides. Commercially available ethylene polyamine mixtures may contain minor amounts of branched species and cyclic species such as N-aminoethyl piperazine, N,N'-bis(aminoethyl)piperazine, N,N'-bis(piperazinyl) ethane, and like compounds. The commercial mixtures may have approximate overall compositions falling in the range corresponding to diethylene triamine to tetraethylene pentamine. The molar ratio of polyalkenyl succinic anhydride to polyalkylene polyamines may be from about 1:1 to about 3:1.

In some embodiments, the ashless dispersant may include the products of the reaction of a polyethylene polyamine, for example, triethylene tetramine or tetraethylene pentamine, with a hydrocarbon substituted carboxylic acid or anhydride made by reaction of a polyolefin, such as polyisobutene, of suitable molecular weight, with an unsaturated polycarboxylic acid or anhydride, for example, maleic anhydride, maleic acid, fumaric acid, or the like, including mixtures of two or more such substances.

Polyamines that are also suitable in preparing the dispersants described herein include N-arylphenylenediamines, such as N-phenylphenylenediamines, for example, N-phenyl-1,4-phenylenediamine, N-phenyl-1,3-phenylendiamine, and N-phenyl-1,2-phenylenediamine; aminothiazoles such as aminothiazole, aminobenzothiazole, aminobenzothiadiazole, and aminoalkylthiazole; aminocarbazoles; aminoindoles; aminopyrroles; amino-indazolinones; aminomercaptotriazoles; aminoperimidines; aminoalkyl imidazoles, such as 1-(2-aminoethyl) imidazole, 1-(3-aminopropyl) imidazole; and aminoalkyl morpholines, such as 4-(3-aminopropyl) morpholine. These polyamines are described in more detail in U.S. Pat. Nos. 4,863,623 and 5,075,383. Such polyamines can provide additional benefits, such as anti-wear and antioxidancy, to the final products.

Additional polyamines useful in forming the hydrocarbyl-substituted succinimides include polyamines having at least one primary or secondary amino group and at least one tertiary amino group in the molecule as taught in U.S. Pat. Nos. 5,634,951 and 5,725,612. Examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), tris(dialkylaminoalkyl) aminoalkylmethanes (three terminal tertiary amino groups and one terminal primary amino group), and like compounds, wherein the alkyl groups are the same or different and typically contain no more than about 12 carbon atoms each, and, as a further example, contain from about 1 to about 4 carbon atoms each. As an even further example, these alkyl groups may be methyl and/or ethyl groups. Polyamine reactants of this type may include dimethylaminopropylamine (DMAPA) and N-methyl piperazine.

Suitable hydroxyamines may include compounds, oligomers or polymers containing at least one primary or secondary amine capable of reacting with the hydrocarbyl-substituted succinic acid or anhydride. Examples of hydroxyamines suitable for use herein include aminoethylethanolamine (AEEA), aminopropyldiethanolamine (APDEA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

The mole ratio of amine to hydrocarbyl-substituted succinic acid or anhydride may range from about 1:1 to about 3.0:1. Another example of a mole ratio of amine to hydrocarbyl-substituted succinic acid or anhydride may range from about 1.5:1 to about 2.0:1.

The foregoing dispersants may also be post-treated, for example, by treating the dispersant with maleic anhydride and boric acid as described, for example, in U.S. Pat. No. 5,789,353 to Scattergood, or by treating the dispersant with nonylphenol, formaldehyde, and/or glycolic acid as described, for example, in U.S. Pat. No. 5,137,980 to DeGonia, et al.

The Mannich base dispersants may be a reaction product of an alkyl phenol, typically having a long chain alkyl substituent on the ring, with one or more aliphatic aldehydes containing from about 1 to about 7 carbon atoms (for example, formaldehyde and derivatives thereof), and polyamines (for example, polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

Hydrocarbon sources for preparation of the Mannich polyamine dispersants may be those derived from substantially saturated petroleum fractions and olefin polymers, such as polymers of mono-olefins having from about 2 to about 6 carbon atoms. The hydrocarbon source may generally contain, for example, at least about 40 carbon atoms, and as a further example, at least about 50 carbon atoms to provide substantial oil solubility to the dispersant. Suitable hydrocarbon sources may include isobutylene polymers and polymers made from a mixture of isobutene and a raffinate I stream.

Suitable Mannich base dispersants may be Mannich base ashless dispersants formed by condensing about one molar proportion of long chain hydrocarbon-substituted phenol with from about 1 to about 2.5 moles of formaldehyde and from about 0.5 to about 2 moles of polyalkylene polyamine.

Polymeric polyamine dispersants suitable as the ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300. Polymeric polyamines may include hydrocarbyl polyamines wherein the hydrocarbyl group is composed of the polymerization product of isobutene and a raffinate I stream as described above. Polyisobutylene ("PIB")-amine and PIB-polyamines may also be used.

Methods for the production of ashless dispersants as described above are known to those skilled in the art and are reported in the patent literature. For example, the synthesis of various ashless dispersants of the foregoing types is described in such patents as U.S. Pat. Nos. 2,459,112; 2,962,442, 2,984,550; 3,036,003; 3,163,603; 3,166,516; 3,172,892; 3,184,474; 3,202,678; 3,215,707; 3,216,936; 3,219,666; 3,236,770; 3,254,025; 3,271,310; 3,272,746; 3,275,554; 3,281,357; 3,306,908; 3,311,558; 3,316,177; 3,331,776; 3,340,281; 3,341,542; 3,346,493; 3,351,552; 3,355,270; 3,368,972; 3,381,022; 3,399,141; 3,413,347; 3,415,750; 3,433,744; 3,438,757; 3,442,808; 3,444,170; 3,448,047; 3,448,048; 3,448,049; 3,451,933; 3,454,497; 3,454,555; 3,454,607; 3,459,661; 3,461,172; 3,467,668; 3,493,520; 3,501,405; 3,522,179; 3,539,633; 3,541,012; 3,542,680; 3,543,678; 3,558,743; 3,565,804; 3,567,637; 3,574,101; 3,576,743; 3,586,629; 3,591,598; 3,600,372; 3,630,904; 3,632,510; 3,632,511; 3,634,515; 3,649,229; 3,697,428; 3,697,574; 3,703,536; 3,704,308; 3,725,277; 3,725,441; 3,725,480; 3,726,882; 3,736,357; 3,751,365; 3,756,953; 3,793,202; 3,798,165; 3,798,247; 3,803,039; 3,804,763; 3,836,471; 3,862,981; 3,872,019; 3,904,595; 3,936,480; 3,948,800; 3,950,341; 3,957,746; 3,957,854; 3,957,855; 3,980,569; 3,985,802; 3,991,098; 4,006,089; 4,011,380; 4,025,451; 4,058,468; 4,071,548; 4,083,699; 4,090,854; 4,173,540; 4,234,435; 4,354,950; 4,485,023; 5,137,980, and Re 26,433, herein incorporated by reference.

Another example of a suitable ashless dispersant is a borated dispersant. Borated dispersants may be formed by boronating (borating) an ashless dispersant having basic nitrogen and/or at least one hydroxyl group in the molecule, such as a succinimide dispersant, succinamide dispersant, succinic ester dispersant, succinic ester-amide dispersant, Mannich base dispersant, or hydrocarbyl amine or polyamine dispersant.

The borated dispersant may contain at least one polyalkylene moiety. As a further example, the borated dispersant, may include at least two polyalkylene moieties. The polyalkylene moiety may have a molecular weight of from about 300 weight average molecular weight to about 3000 weight average molecular weight. The polyalkylene moiety, for example, may have a molecular weight of from about 1300 weight average molecular weight to about 2100 weight average molecular weight. As a further example, the polyalkylene moiety may have a molecular weight of about 2100 weight average molecular weight. The polyalkylene moiety may include a polybutenyl group. Methods that can be used for boronating the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; 4,652,387; and 4,857,214.

The borated dispersant may include a high molecular weight dispersant treated with boron such that the borated dispersant includes up to 2 wt % of boron. As another example the borated dispersant may include from about 0.8 wt % or less of boron. As a further example, the borated dispersant may include from about 0.1 to about 0.7 wt % of boron. As an even further example, the borated dispersant may include from about 0.25 to about 0.7 wt % of boron. As a further example, the borated dispersant may include from about 0.35 to about 0.7 wt % of boron. The dispersant may be dissolved in oil of suitable viscosity for ease of handling. It should be understood that the weight percentages given here are for neat dispersant, without any diluent oil added.

A dispersant may be further reacted with an organic acid, an anhydride, and/or an aldehyde/phenol mixture. Such a process may enhance compatibility with elastomer seals, for example. The borated dispersant may further include a mixture of borated dispersants. As a further example, the borated dispersant may include a nitrogen-containing dispersant and/or may be free of phosphorus.

A suitable dispersant may be a phosphorylated dispersant. For example, a Mannich or a succinimide dispersant may be reacted with a phosphorus compound, such as a phosphorus-containing acid. Suitable phosphorus-containing acids include, for example, phosphorus acid ($H_3PO_3$), dibutyl hydrogen phosphite (DBHP), dialkyldithiophosphoric acids, and the like. Further, a succinimide dispersant, such as a polyisobutylene succinic anhydride, may be phosphorylated and/or boronated to provide a suitable dispersant.

A dispersant may be present in the power transmission fluid in an amount of about 0.1 wt % to about 10 wt %. Further, the power transmission fluid may include from about 2 wt % to about 7 wt % of the dispersant. Further, in some embodiments, the power transmission fluid may include from about 3 wt % to about 5 wt % of the dispersant. Further, the power transmission fluid may include an amount of a borated dispersant sufficient to provide up to 1900 parts per million (ppm) by weight of boron in the finished fluid, such as for example, from about 50 to about 500 ppm by weight of boron in the finished fluid.

Optional Components

The power transmission fluid may also include conventional additives of the type used in automatic transmission fluid formulations in addition to the ashless dispersants and oil-soluble aliphatic tertiary amines described above. Such additives include, but are not limited to, friction modifiers, antioxidants, extreme pressure additives, corrosion inhibitors, antiwear additives, metal deactivators, antifoamants, pour point depressants, air entrainment additives, metallic detergents, and/or seal swell agents.

Additives used in formulating the compositions described herein can be blended into the base oil individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The power transmission fluids disclosed herein may include fluids suitable for any power transmitting application, such as a step automatic transmission or a manual transmission. Further, the power transmission fluids of the present invention are suitable for use in transmissions with a slipping torque converter, a lock-up torque converter, a starting clutch, and/or one or more shifting clutches. Such transmissions include four-, five-, six-, and seven-speed transmissions, and continuously variable transmissions (chain, belt, or disk type). They may also be used in manual transmissions, including automated manual and dual-clutch transmissions.

In this regard, prior to adding the aliphatic tertiary amine component to the power transmission fluid, the power transmission fluid may contain the following composition:

| Component | Wt. % |
|---|---|
| Friction modifiers | 0.01 to 0.5 |
| Sulfur agents | 0.01 to 0.5 |
| Anti-oxidants | 0.01 to 2.0 |
| Anti-rust agents | 0.01 to 0.3 |
| Detergents | 0.01 to 1.0 |
| Ashless dispersant | 0.5 to 10.0 |
| Anti-foam agents | 0.0001 to 0.5 |
| Base oil | Balance |

EXAMPLES

Transmission fluid samples prepared in accordance with embodiments of the invention were tested and evaluated for effectiveness in modifying friction. The friction characteristics of the fluid samples were measured using an LFW-1 block on ring test apparatus, wherein a fluid sample was applied between the block and ring of the LFW-1 test apparatus 1 shown in FIG. 1A.

The apparatus 1 was equipped with a block 2 having a contact surface 3 made of a paper friction material, a stainless steel ring 4, and a force detector 5. Load 6 is applied to the block 2 and the resistance caused by the rotation of the ring 4 is measured by the force detector 5. The lower portion of the ring is immersed in a fluid sample 7 to be tested.

Figure 1B:
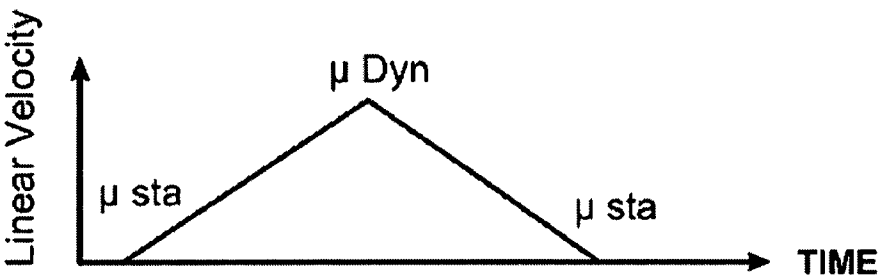
FIG. 1B is a graphic illustration of a speed profile for the fluid testing apparatus of FIG. 1A.

The load applied to the block was about 27.2 kg, and the ring was rotated relative to the block in cycles of acceleration for about 40 sec from about 0 to about 0.5 m/sec and then deceleration from about 0.5 to about 0 m/sec at about 121° C. Rotation of the ring followed the speed profile shown in FIG. 1B.

The friction between the block and ring during the cycles were measured to provide a plurality of measurements for both a new fluid sample and an aged fluid sample to yield information relating to friction durability of the fluid sample. The fluid samples were aged by subjecting them to an oxidation bath for a period of time at a thermally degrading temperature, such as 100 and 200 hours at 170° C. The resulting friction performance measurements or friction durability were then compared. Friction measured at low speeds (close to zero) were averaged as μ static and those at the center (max speed) were averaged as μ dynamic.

Figure 2:
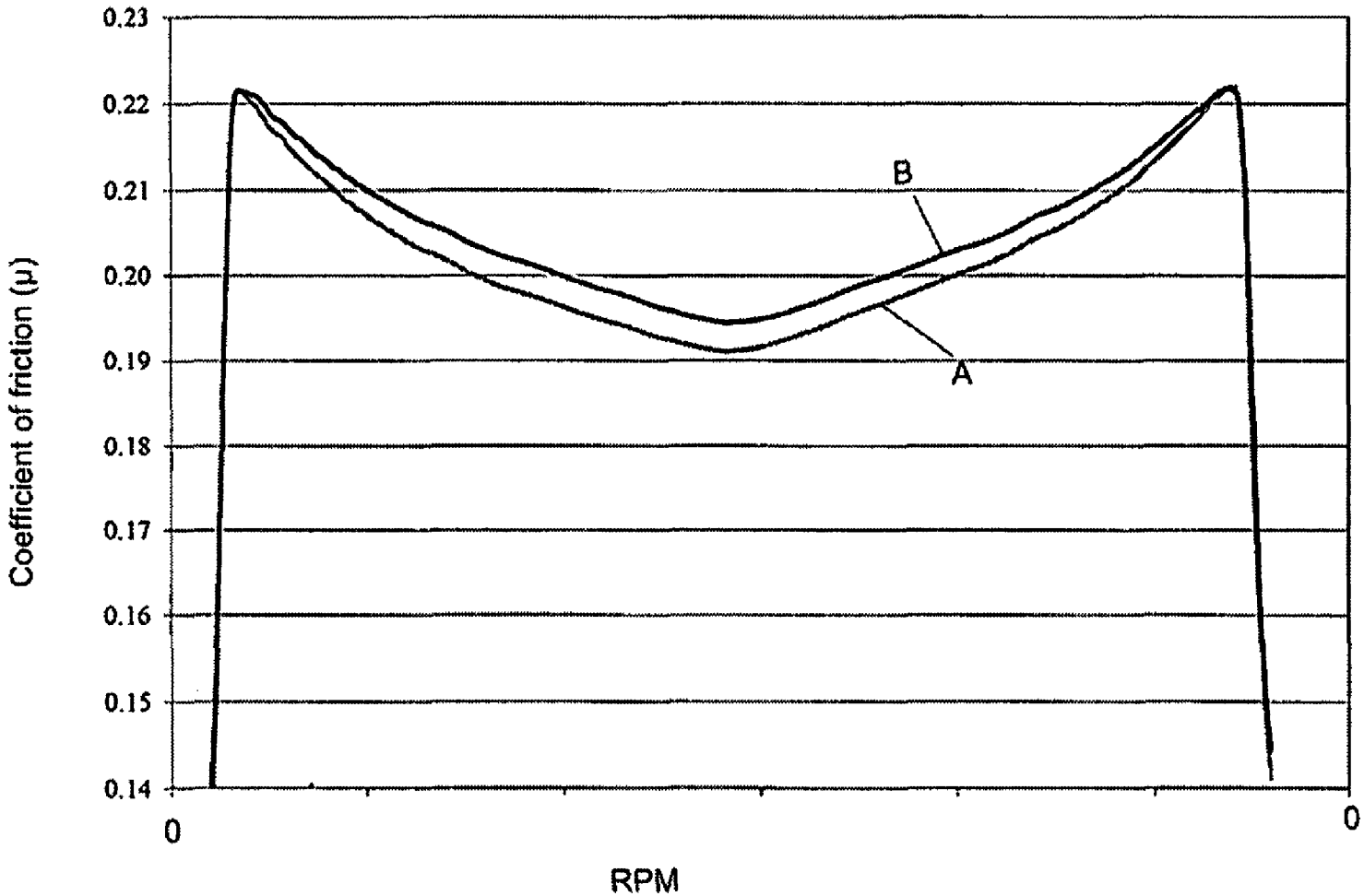
FIG. 2 illustrates friction profiles for a comparative fluid sample.

With reference to FIG. 2, there is shown a graph of measurements of the friction characteristics of a reference oil-based fluid sample (sample #1 in Table 1) having an ashless dispersant but not treated to include an oil-soluble aliphatic tertiary amine component in accordance with the invention. Curve A represents the friction characteristics of the fluid before aging, and curve B represents the friction characteristics after aging as described above.

The data shown in FIG. 2 was acquired using LFW-1 block on ring test apparatus and aging the fluid as described above.

Figure 3:
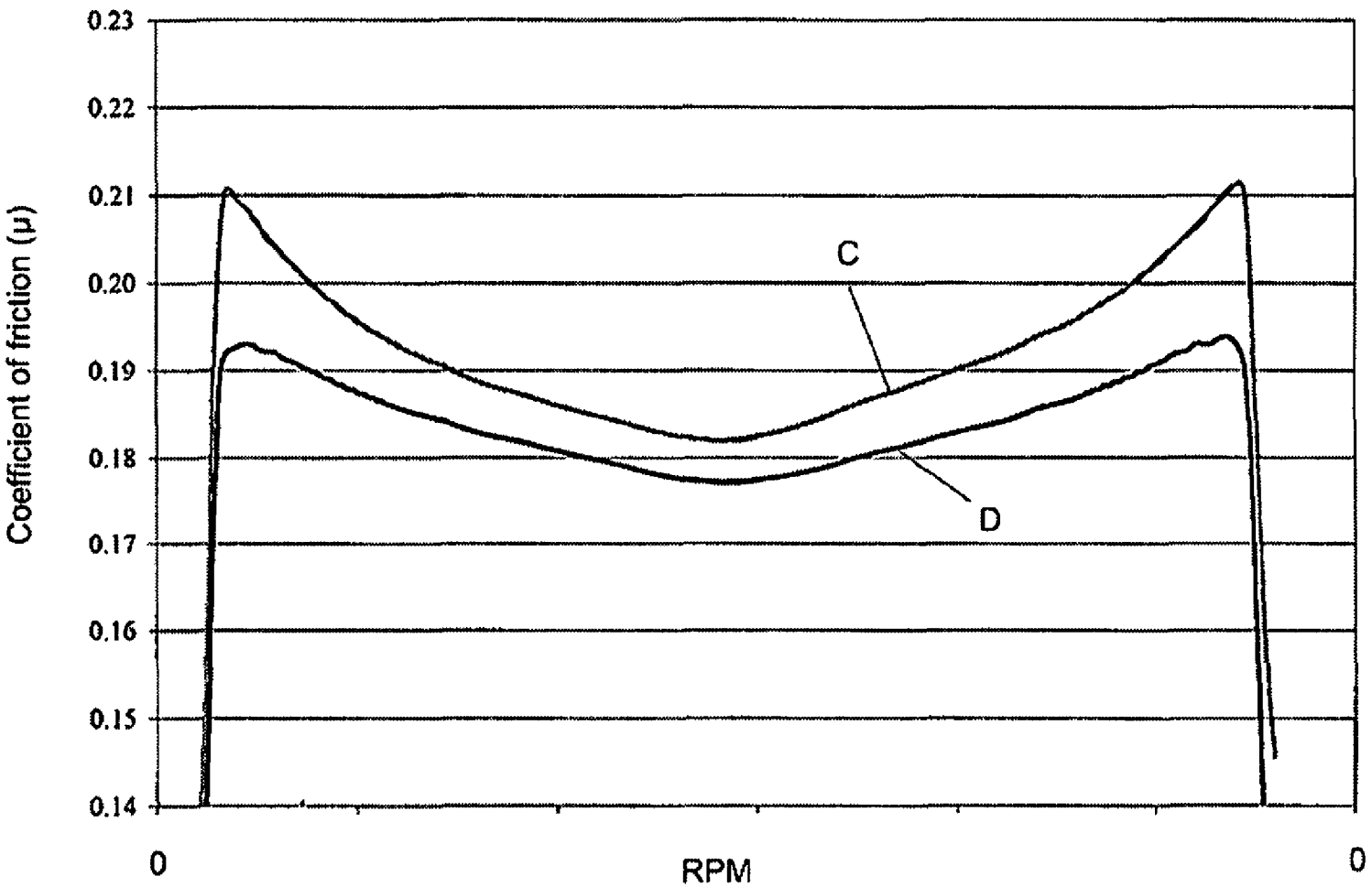
FIG. 3 illustrates friction profiles for a first fluid sample according to the disclosure.

With reference to FIG. 3, there is shown a graph of measurements of the friction characteristics of a reference oil-based fluid sample (sample #2 in Table 1) having an ashless dispersant and treated to include an oil-soluble aliphatic tertiary amine component (0.5 wt. %). Curve C represents the friction characteristics of the fluid before aging, and curve D represents the friction characteristics after aging as described above.

The data shown in FIG. 3 was acquired using LFW-1 block on ring test apparatus and aging the fluid as described above.

Figure 4:
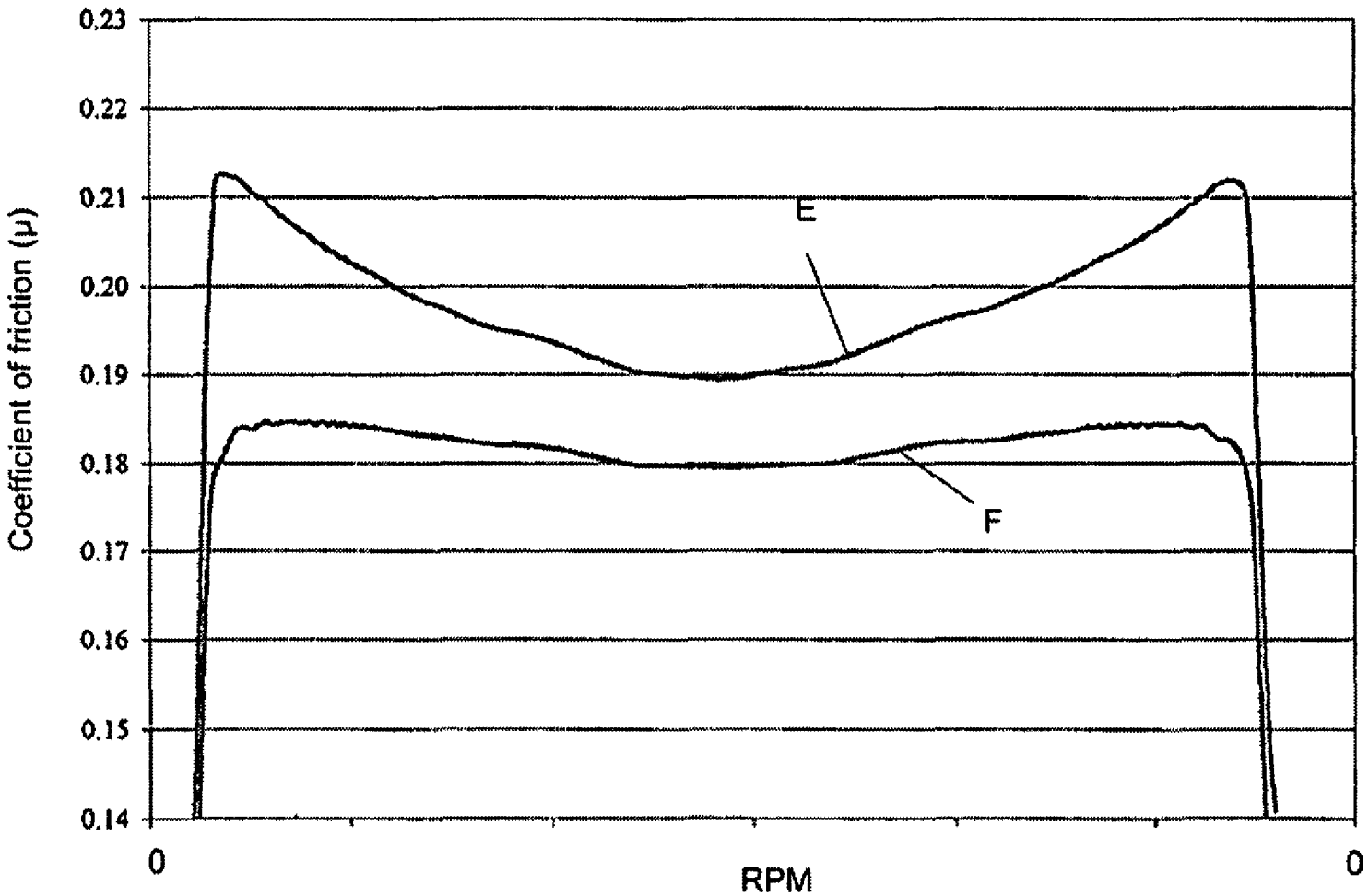
FIG. 4 illustrates friction profiles for a second fluid sample according to the disclosure.

With reference to FIG. 4, there is shown a graph of measurements of the friction characteristics of a reference oil-based fluid sample (sample #3 in Table 1) having an ashless dispersant and treated to include an oil-soluble aliphatic tertiary amine component (1.0 wt. %). Curve E represents the friction characteristics of the fluid before aging, and curve F represents the friction characteristics after aging as described above.

The data shown in FIG. 4 was acquired using LFW-1 block on ring test apparatus and aging the fluid as described above.

Figure 5:
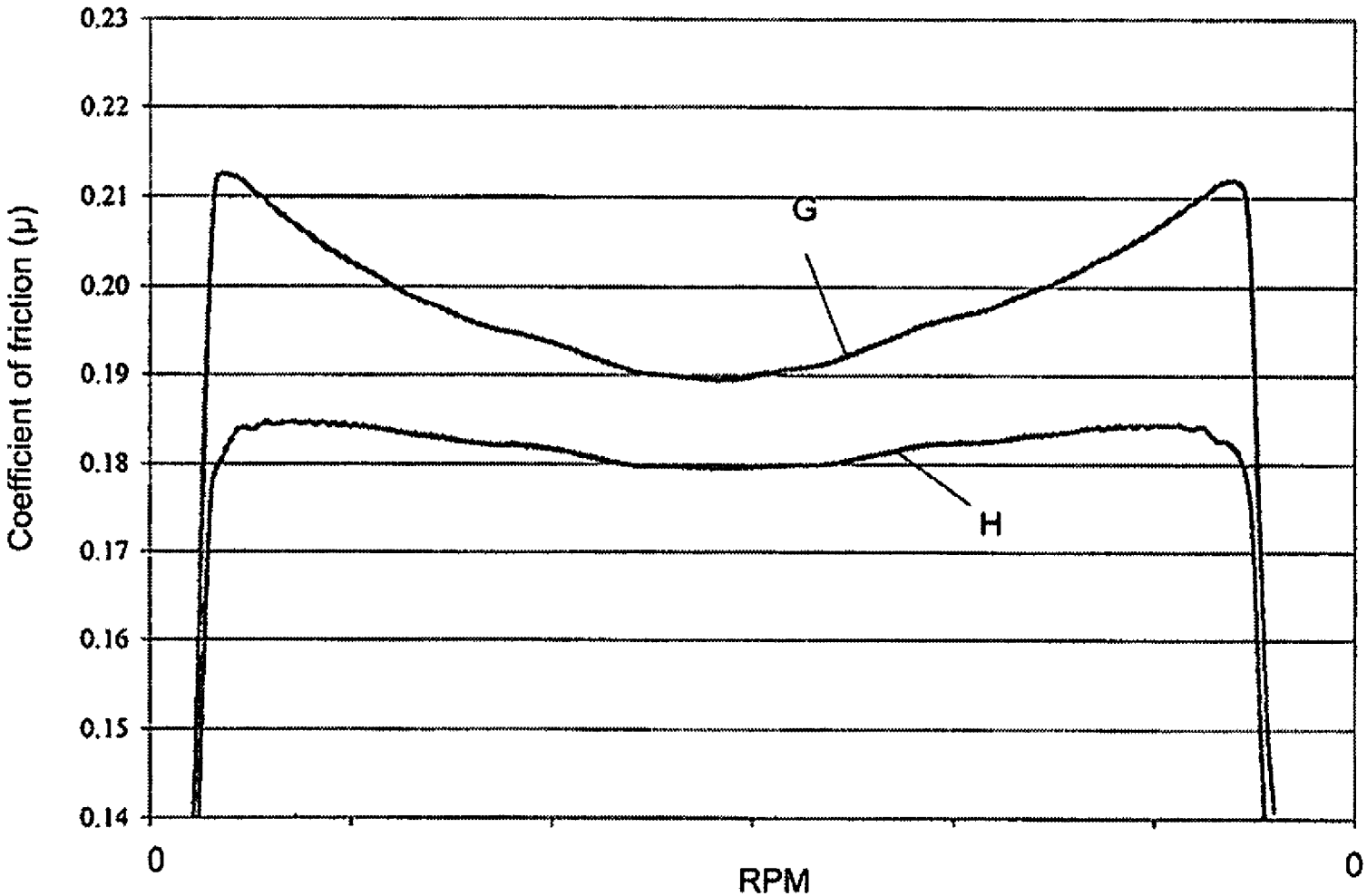
FIG. 5 illustrates friction profiles for a third fluid sample according to the disclosure.

With reference to FIG. 5, there is shown a graph of measurements of the friction characteristics of a reference oil-based fluid sample (sample #4 in Table 1) having an ashless dispersant and treated to include an oil-soluble aliphatic tertiary amine component (4.0 wt. %). Curve G represents the friction characteristics of the fluid before aging, and curve H represents the friction characteristics after aging as described above.

The data shown in FIG. 5 was acquired using LFW-1 block on ring test apparatus and aging the fluid as described above.

Figure 6:
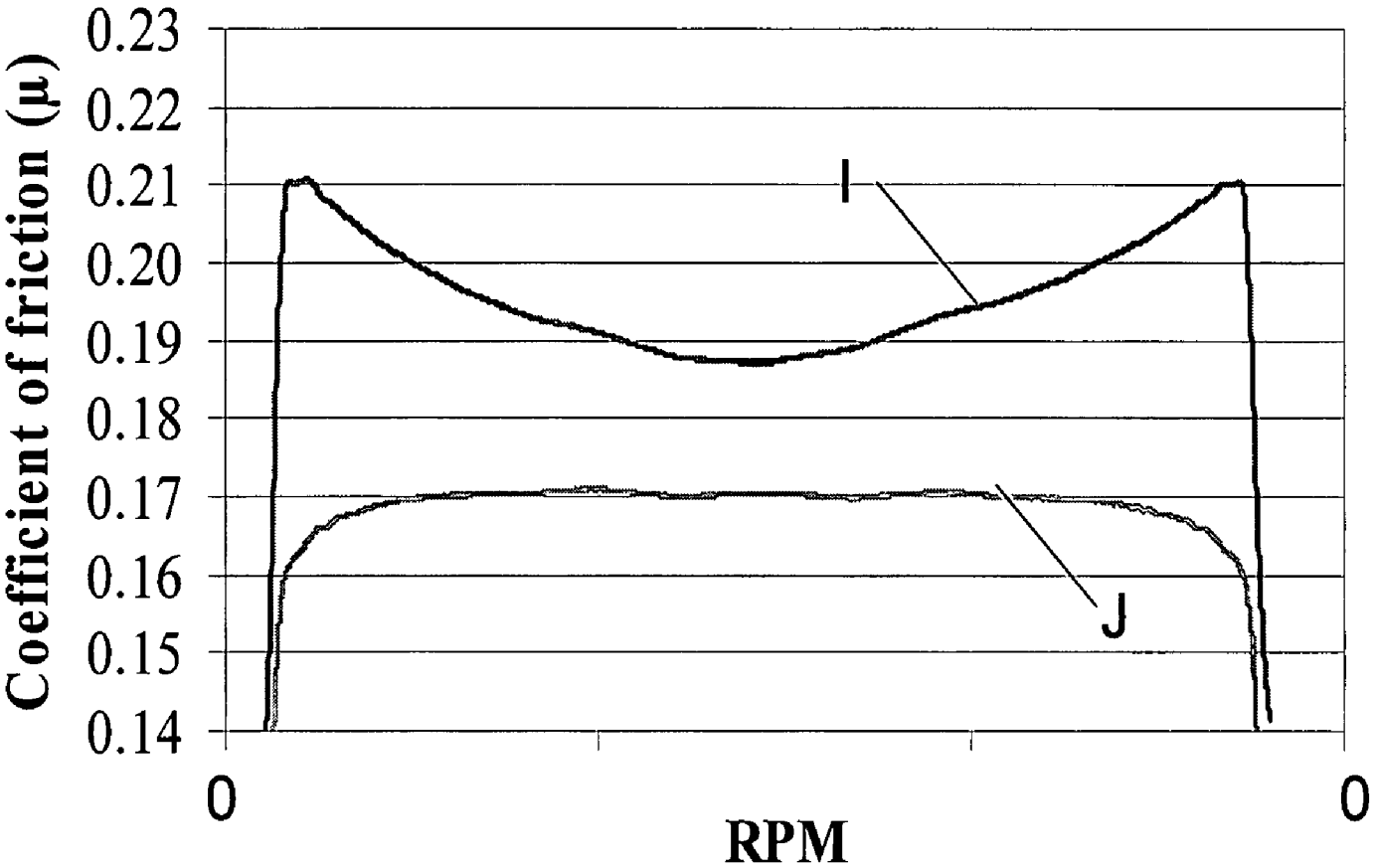
FIG. 6 illustrates friction profiles for a fourth fluid sample according to the disclosure.

With reference to FIG. 6, there is shown a graph of measurements of the friction characteristics of a reference oil-based fluid sample (sample #5 in Table 1) having an ashless dispersant and treated to include an oil-soluble aliphatic tertiary amine component (4.0 wt. %) in accordance with the invention. Curve I represents the friction characteristics of the fluid before aging, and curve J represents the friction characteristics after aging as described above.

The data shown in FIG. 6 was acquired using LFW-1 block on ring test apparatus and aging the fluid as described above.

TABLE 1

Effectiveness of Addition of Oil-soluble Aliphatic Tertiary Amine in Modifying Friction

| Fluid Sample | Static/ Dynamic Initial | Static/ Dynamic Aged (100 Hrs @ 170° C.) | Static/ Dynamic Aged (200 Hrs @ 170° C.) |
|---|---|---|---|
| 1 | 1.129 | 1.113 | — |
| 2 | 1.131 | 1.063 | — |
| 3 | 1.146 | 0.997 | — |
| 4 | 1.096 | — | 0.992 |
| 5 | 1.103 | — | 0.939 |

In evaluating the data shown in Table 1, better friction durability is indicated by the ratio of static to dynamic friction being a lower number, preferably less than about 1, such as, example, 0.939. Thus, all of the fluid samples representing fluid treated in accordance with the invention surpass the control in friction durability.

At numerous places throughout this specification, reference has been made to a number of U.S. Patents. All such cited documents are expressly incorporated in full into this disclosure as if fully set forth herein.

Other embodiments of the present invention will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The invention claimed is:

1. A method of improving the friction durability of a transmission fluid comprising:

preparing a transmission fluid by adding to a base oil, an additive composition comprising:

an ashless dispersant, present in an amount from 3 to 5 wt % based on the transmission fluid and an oil-soluble aliphatic tertiary amine component, wherein the oil-soluble aliphatic tertiary amine component comprises an oil-soluble aliphatic tertiary amine of the formula

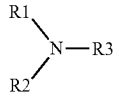

wherein the R1 group comprises an alkyl or alkenyl group having about 1 to about 4 carbon atoms, and the R2 and R3 groups independently comprise any one of an alkyl, an alkenyl, and an alkynyl group, having from about 10 to about 30 carbon atoms, wherein the oil-soluble aliphatic tertiary amine is present in an amount from about 0.5 to about 8 percent by weight, and wherein the power transmission fluid exhibits improved friction durability relative to a power transmission fluid not containing the tertiary amine in an amount from about 0.5 to about 8 percent by weight; and combining the additive composition with the transmission fluid.

2. The method of claim 1, wherein the fluid has improved durability compared to a transmission not containing the ashless dispersant and the oil-soluble aliphatic tertiary amine.

3. The method of claim 1, wherein the base oil comprises one or more of a natural oil, a mixture of natural oils, a synthetic oil, a mixture of synthetic oils, and a mixture of natural and synthetic oils.

4. The method of claim 3, wherein the natural oil comprises one or more of a mineral oil, a vegetable oil, and a mixture of mineral oil and vegetable oil.

5. The method of claim 3, wherein the synthetic oil comprises one or more of an oligomer of an alphaolefin, an ester, an oil derived from a Fischer-Tropsch process, a gas-to-liquid stock, and a mixture thereof.

6. The method of claim 1, wherein the base oil has a kinematic viscosity of from about 2 centistokes to about 10 centistokes at about 100° C.

7. The method of claim 1, wherein R2 and R3 independently contain from about 12 to about 30 carbon atoms.

8. The method of claim 1, wherein the oil-soluble aliphatic tertiary amine is present in an amount from about 0.5 to about 4 percent by weight.

9. The method of claim 1, wherein the oil-soluble aliphatic tertiary amine is present in an amount from about 0.5 to about 1.5 percent by weight.

10. The method of claim 1, wherein providing the additive composition comprises providing an additive composition further comprising one or more of an antioxidant, an antiwear agent, a friction modifier, an antifoam agent, and a corrosion inhibitor.

11. The method of claim 1, wherein the ashless dispersant comprises one or more of a hydrocarbyl succinimide, a hydrocarbyl succinamide, a polyol ester, a mixed ester/amide of hydrocarbyl substituted succinic acid, and a Mannich condensation product of hydrocarbyl-substituted phenols, a formaldehyde, and a polyamine.

12. The method of claim 1 further comprising:

subjecting the fluid to oxidative and thermal stressing.

13. The method of claim 1, wherein improving the durability of the transmission fluid includes improving anti-rattle performance of a continuously variable transmission fluid.

14. The method of claim 1, wherein improving the durability of the transmission fluid includes improving dynamic friction in a 6-speed transmission fluid.

15. The method of claim 1, wherein improving the durability of the transmission fluid includes improving anti-shudder durability in continuously slipping torque converter clutch fluid.

16. The method of claim 1, wherein the transmission fluid is suitable for use in a transmission employing one or more of a slipping torque converter, a lock-up torque converter, a starting clutch and one or more shifting clutches.

17. The method of claim 1, wherein the transmission fluid is suitable for use in a belt, chain, or disk-type continuously variable transmission.

* * * * *